US006047153A

United States Patent [19]

Kawaguchi

[11] Patent Number: 6,047,153

[45] **Date of Patent: *Apr. 4, 2000**

[54] TONER CONTAINER, PROCESS CARTRIDGE, AND IMAGE FORMING APPARATUS

[75] Inventor: Hideshi Kawaguchi, Toride, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,253

[22] Filed: Jun. 16, 1997

[30] Foreign Application Priority Data

Jun. 17, 1996 [JP] Japan ..... 8-177109

[51] Int. Cl.[7] ..... G03G 15/08

[52] U.S. Cl. ..... 399/263; 399/111; 399/254

[58] Field of Search ..... 399/98, 102, 103, 399/106, 107, 110, 111, 167, 254, 256, 263; 366/252, 272, 283

[56] References Cited

U.S. PATENT DOCUMENTS

| | | | |
|---|---|---|---|
| 4,829,335 | 5/1989 | Kanemitsu et al. | 399/111 |
| 5,019,861 | 5/1991 | Surti . | |
| 5,126,800 | 6/1992 | Shishido et al. | 399/111 |
| 5,134,441 | 7/1992 | Nagata et al. | 399/103 |
| 5,541,710 | 7/1996 | Stewart et al. | 399/98 |
| 5,572,301 | 11/1996 | Shiratori | 399/263 X |
| 5,642,186 | 6/1997 | Michlin et al. | 399/107 |
| 5,650,841 | 7/1997 | Matsuda et al. | 399/111 |

FOREIGN PATENT DOCUMENTS

| | | |
|---|---|---|
| 0458318 | 11/1991 | European Pat. Off. . |
| 0708387 | 4/1996 | European Pat. Off. . |
| 62-269978 | 11/1987 | Japan . |

*Primary Examiner*—Sandra Brase

*Attorney, Agent, or Firm*—Fitzpatrick, Cella, Harper & Scinto

[57] ABSTRACT

A toner container mountable to a main assembly of an electrophotographic image forming apparatus includes a toner containing portion for containing toner; a rotatable toner stirring member for stirring the toner contained in the toner containing portion; a helical gear for receiving driving force for rotating the stirring member, the helical gear being movable in a thrust direction which is substantially crossing with a direction of rotation thereof; an opposite member opposed to an internal surface of the toner containing portion with a gap therebetween, the opposite member being notable together with the helical gear; wherein thrust force produced when the helical gear is rotated with the opposite member being spaced from the internal surface of toner containing portion, is oriented in a direction from outside to inside of the toner containing portion.

23 Claims, 8 Drawing Sheets

TONER CONTAINER, PROCESS CARTRIDGE, AND IMAGE FORMING APPARATUS

FIELD OF THE INVENTION AND RELATED ART

The present invention relates to a toner container, a process cartridge and an image forming apparatus usable with the process cartridge.

Here, the image forming apparatus includes an electrophotographic copying machine, an electrophotographic printer (for example, LED printer, laser beam printer), and electrophotographic facsimile machine, an electrophotographic word processor, and the like.

The term process cartridge refers to a cartridge having as a unit, an electrophotographic photosensitive member, and charging means, developing means and cleaning means, which is detachably mountable to the main assembly of an image forming apparatus. It may include as a unit an electrophotographic photosensitive member and at least one of the following: charging means, developing means and cleaning means. It may include as a unit developing means and an electrophotographic photosensitive member.

An image forming apparatus using an electrophotographic process is known which is used with a process cartridge. This is advantageous in that the maintenance operation can be, in effect, carried out by the users thereof without expert service persons, and therefore, the operativity can be remarkably improved. Therefore, this type is now widely used.

The toner container (hereinafter, T container) of this type of electrophotographic image forming apparatus comprises a developer (toner) stirring means, for example, a stirring plate or a stirring rod, which is driven by a force externally transmitted, by way of gears and the like, to a stirring gear which supports one end of the toner stirring rod. The stirring gear is supported by the toner container or a like by the boss portion. Between the toner container wall and the stirring gear, a sealing member composed of woolen felt or the like is placed to prevent the toner contained in the toner container from leaking out. The stirring gear is formed of resin material such as POM, and is attached to the toner container by snap-fitting. As for the transmission of the driving force to the stirring gear, the driving force from an unillustrated motor is transmitted to the actual spur gear portion of the stirring gear by way of a gear train or the like.

SUMMARY OF THE INVENTION

The present invention is the result of the further development of the conventional art described above.

Accordingly, a primary object of the present invention is to provide a toner container, a process cartridge, and an electrophotographic image forming apparatus, in which toner particles are not aggregated into coarse toner particles by the contact between the internal surface of the toner container wall, and a component (for example, a retainer member such as a retainer ring) disposed within the toner container in a manner to oppose the internal surface of the toner container.

Another object of the present invention is to provide a toner container, a process cartridge, and an electrophotographic image forming apparatus, in which toner particles are not aggregated into coarse toner particles by the heat generated by the friction between the internal surface of the toner container wall and a component (for example, a regainer member such as a retainer ring), which occurs as the component opposing the internal surface of the toner container wall is rotated in contact with the surface of the toner container wall.

Another object of the present invention is to provide a toner container, a process cartridge, and an electrophotographic image forming apparatus, which are inexpensive, yet capable of producing a desirable image.

Another object of the present invention is to provide a toner container, a process cartridge, and an electrophotographic image forming apparatus, which have a structure in which, when a helical gear is rotated, the thrust generated by the rotation of the helical gear is directed inward of the toner container in order to maintain a gap between the internal surface of the toner container wall, and a rotary component disposed within the toner container in such a manner to oppose the internal surface of the toner container wall.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiments

Hereinafter, the embodiments of the present invention will be described with reference to the drawings.

In this embodiment, the term, "longitudinal direction", means the horizontal direction perpendicular to the direction in which a recording medium is conveyed in an electrophotographic image forming apparatus, and it means the same when used in the description of a process cartridge.

Embodiment 1

First, the general structures of a typical electrophotographic image forming apparatus (hereinafter, image forming apparatus), and a typical process cartridge, and then, the structure of the stirring means, will be described.

(General Structure)

Figure 3:
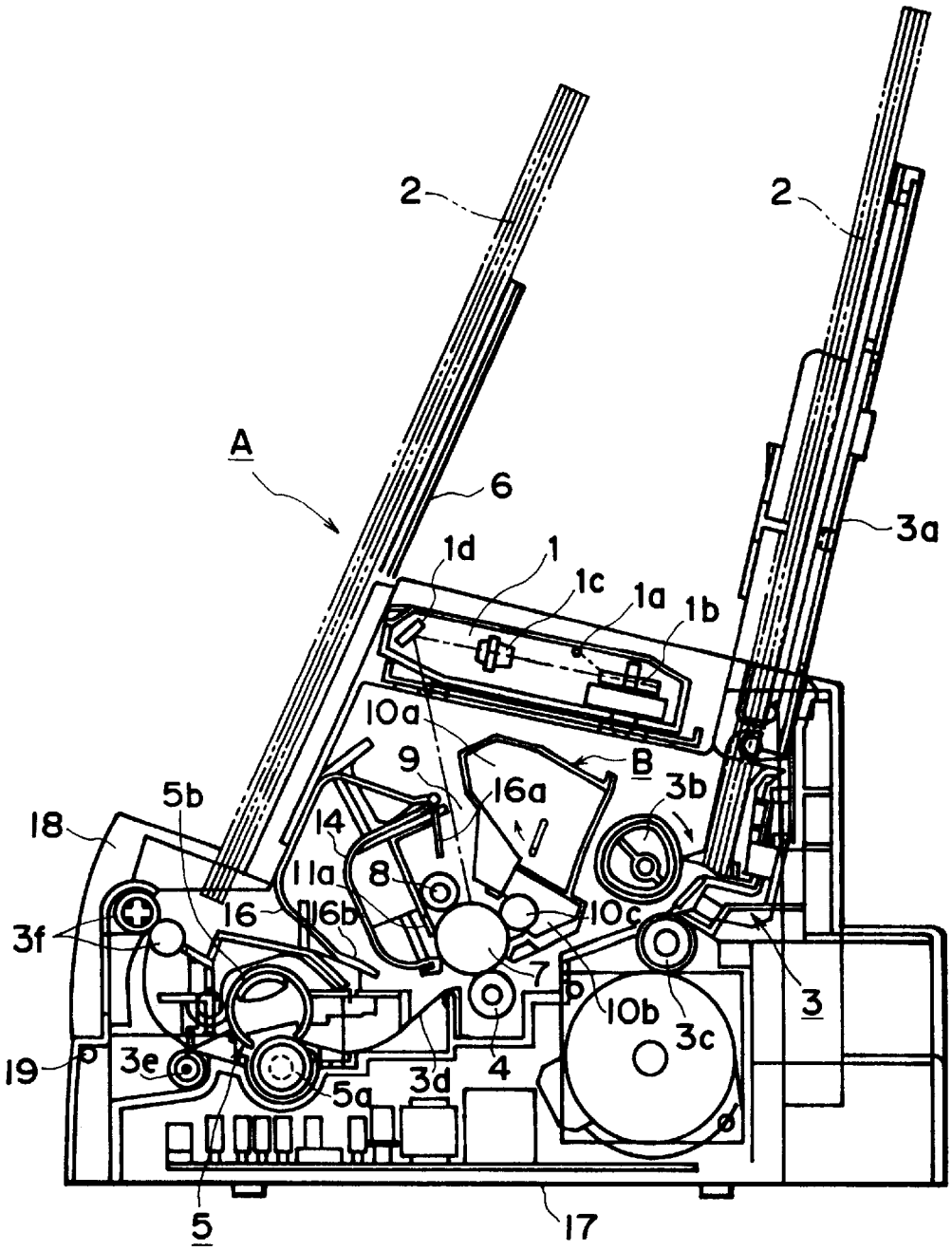
FIG. 3 is a vertical section of the image forming apparatus in the first embodiment of the present invention, depicting the general structure thereof.
Figure 4:
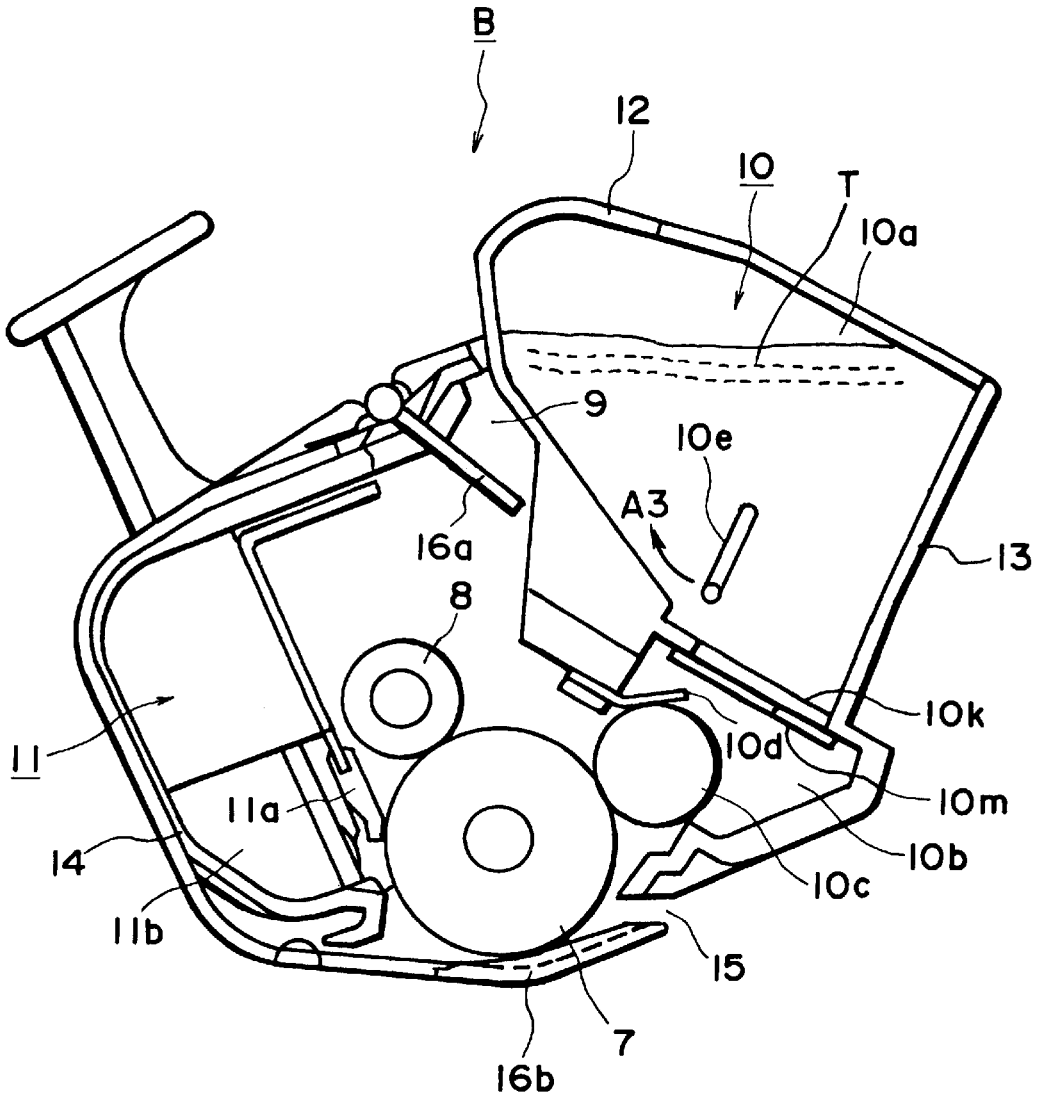
FIG. 4 is a vertical section of the process cartridge in the first embodiment of the present invention, depicting the general structure thereof.
Figure 5:
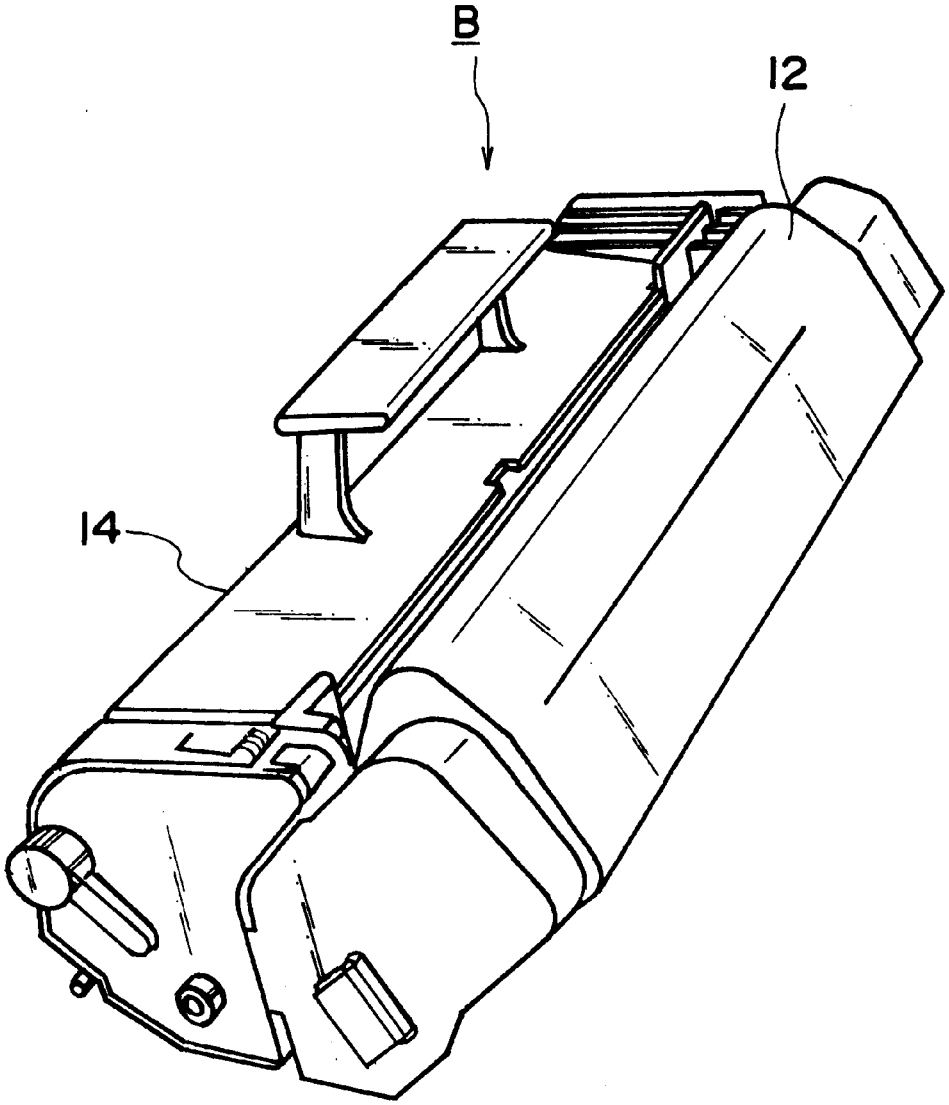
FIG. 5 is an external perspective view of the process cartridge in the first embodiment of the present invention.
Figure 6:
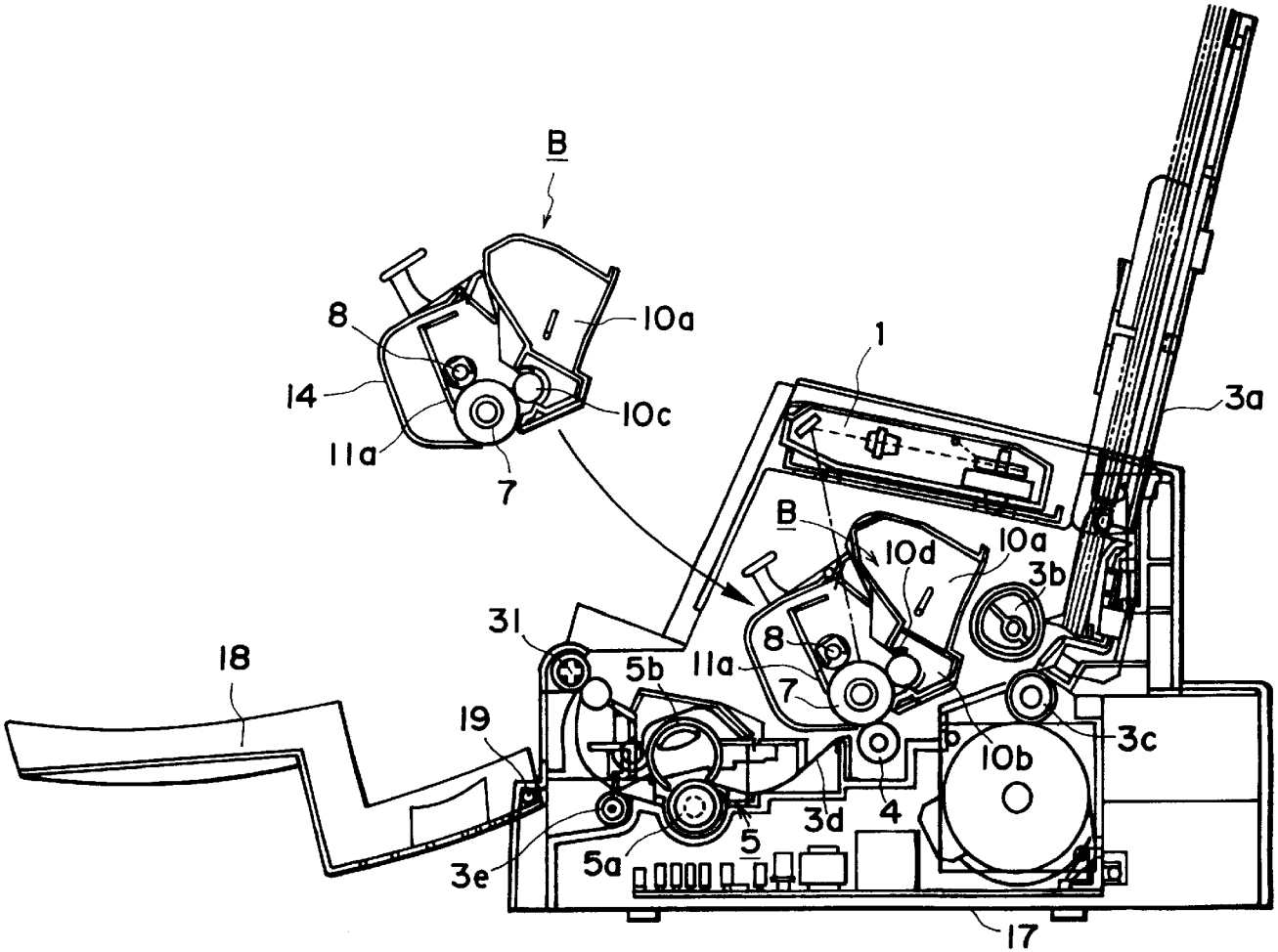
FIG. 6 is a vertical section of the process cartridge and image forming apparatus in the first embodiment of the present invention, depicting the way the former is installed into, or removed from, the latter.

Referring to FIGS. 3–6, the general structure of a typical image forming apparatus, and a typical process cartridge, will be described. FIG. 3 depicts the general structure of an image forming apparatus in which a process cartridge has been installed. FIGS. 4 and 5 depict the structure of a process cartridge. FIG. 6 depicts an image forming apparatus, the cover of which is open, and a process cartridge ready to be installed, depicting the way the latter is installed into the former.

Referring to FIG. 3, an image forming apparatus A forms an image on a recording medium through an electrophotographic image forming process. In this process, a toner image is first formed on an electrophotographic photosensitive member (hereinafter, photosensitive drum) 7 in the form of a drum. In synchronism with toner image formation, a recording medium 2 placed in a feeder tray 3*a* is fed into the image forming apparatus by a conveying means which comprises a pickup roller 3*b*, a conveyer roller 3*c*, and the like. Next, the toner image formed on the photosensitive drum 7, which is contained in a process cartridge, is transferred onto the recording medium 2 by means of applying voltage to a transfer roller 4 as a transferring means. Then, the recording medium 2 having received the toner image is conveyed to a fixing means 5 by a guide 3*d*. The fixing means 5 comprises a driving roller 5*a*, and a fixing roller 5*b* which contains a heater. It applies heat and pressure to the recording medium 2 while the recording medium 2 is passed through the fixing means 5. As a result, the toner image having transferred onto the recording medium 2 is fixed to the recording medium 2. Thereafter, the recording medium 2 is conveyed by discharge rollers 3*e* and 3*f*, the recording medium 2 being inverted while conveyed, and then, is discharged into a delivery tray 6.

Referring to FIGS. 3–5, in the process cartridge B, the photosensitive drum 7 is rotated, and the surface of the photosensitive drum 7 is uniformly charged by applying voltage to a charge roller 8 as a charging means. Next, a laser beam modulated in accordance with image data is projected from an optical system 1 onto the photosensitive drum 7 through an exposure opening 9 to form a latent image. The thus formed latent image is developed by toner, using a developing means 10. More specifically, the charge roller 8 is placed in contact with the photosensitive drum 7 to charge the photosensitive drum 7. The developing means 10 supplies toner onto the peripheral surface of the photosensitive drum 7 to develop the latent image formed on the photosensitive drum 7. The optical system 1 comprises a laser diode 1*a*, a polygon mirror 1*b*, a lens 1*c*, and a deflective mirror 1*d*.

The developing means 10 comprises a toner chamber 10*a*, and a development chamber 10*b*. Before the process cartridge B is used for the first time, the opening 10*k* which connects the toner chamber 10*a* and the development chamber 10*b* is sealed with a sealing member 10*m* in the form of film, toner T being sealed in the toner chamber 10*a*. When the cartridge B is used for the first time, the sealing member 10*m* is removed by the user to allow the toner T in the toner chamber to be sent into the development chamber 10*b*. In the toner chamber 10*a*, the toner is stirred by a stirring rod 10*e*. As the toner is stirred, it is sent into the development chamber 10*b*, in which a development roller 10*c* containing a stationary magnet is rotated. As the developing roller 10*c* is rotated, the toner is adhered onto the peripheral surface of the development roller 10*c*, and then, is formed into a toner layer by a development blade 10*d*. During this process, the toner receives triboelectric charge. As the development roller 10*c* is further rotated, the toner is carried to a developing station, that is, where the peripheral surface of the photosensitive drum 7 comes closest to the peripheral surface of the development roller 10*c*. In the development station, the toner transfers onto the photosensitive drum 7 in accordance with the latent image, developing thereby the latent image into a toner image, a visible image.

Next, voltage having the polarity opposite to that of the toner is applied to the transfer roller 4 to transfer the toner image formed on the photosensitive drum 7 onto the recording medium 2. Thereafter, the toner remaining on the photosensitive drum 7 is removed by a cleaning means 11. More specifically, during this toner cleaning process, the toner remaining on the photosensitive drum 7 is scraped into a waste toner collector 11*b*, being collected therein, by the elastic cleaning blade 11*a* of the cleaning means 11.

The aforementioned photosensitive drum 7 and various other components are integrally placed in a cartridge frame formed by joining a toner chamber wall 12, a development chamber wall 13, and a cleaning chamber wall 14; they are integrated into a process cartridge. More specifically, first, the toner chamber wall 12 and the development chamber wall 13 are welded together to form a toner chamber 10*a* and a development chamber 10*b*. Then, the development roller 10*c* and the development blade 10*d* are disposed in the development chamber 10*b*, whereas the photosensitive drum 7, the charge roller 8, and the various components which constitute the cleaning means 11, are mounted on the cleaning chamber wall 14. Thereafter, the toner chamber wall 12 and the cleaning chamber wall 4 are joined in a manner to be pivotable relative to each other, comprising the process cartridge B.

The process cartridge B is provided with an exposure opening 9 through which a light beam reflecting image data is projected onto the photosensitive drum 7, and a transfer opening 15 through which the photosensitive drum 9 opposes the recording medium 2 so that the toner image formed on the photosensitive drum 7 can be transferred onto the recording medium 2. Also, the process cartridge 7 is provided with shutters 16*a* and 16*b* for exposing or covering the opening 19 and 15, respectively.

As for the image forming apparatus A, referring to FIG. 6, a cover 18 is pivotally openable about an axis 19 and is attached to an apparatus main assembly 17. As the cover 18 is opened, an unillustrated guiding member for guiding the process cartridge B is exposed, and the process cartridge B is installed into, or removed from., the apparatus main assembly 7 along this guiding member by an operator. As the process cartridge B is installed into the apparatus main assembly 17, a drum gear 7*a* (helical gear illustrated in FIGS. 1, 7, 8 and 10) solidly fixed to one of the longitudinal ends of the photosensitive drum 7 meshes with the driving gear AG (helical gear illustrated in FIGS. 1, 7, 8 and 10) of the apparatus main frame 17, readying the process cartridge B to be driven by the drum gear 7*a* which is driven by the driving gear AG to which the driving force is transmitted from a power source, a motor, through power transmittion members.

(Toner Stirring Structure in Toner Chamber)

Figure 1:
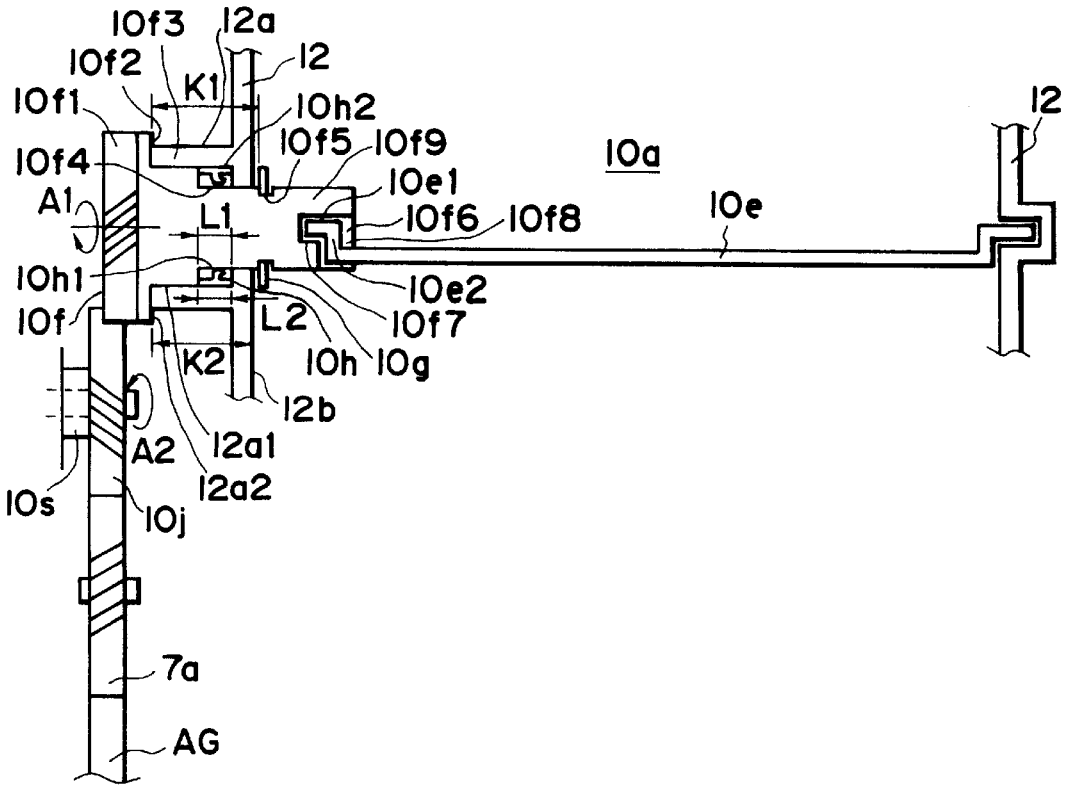
FIG. 1 is a horizontal section of the toner stirring portion in the first embodiment of the present invention, depicting the general structure thereof.
Figure 2:
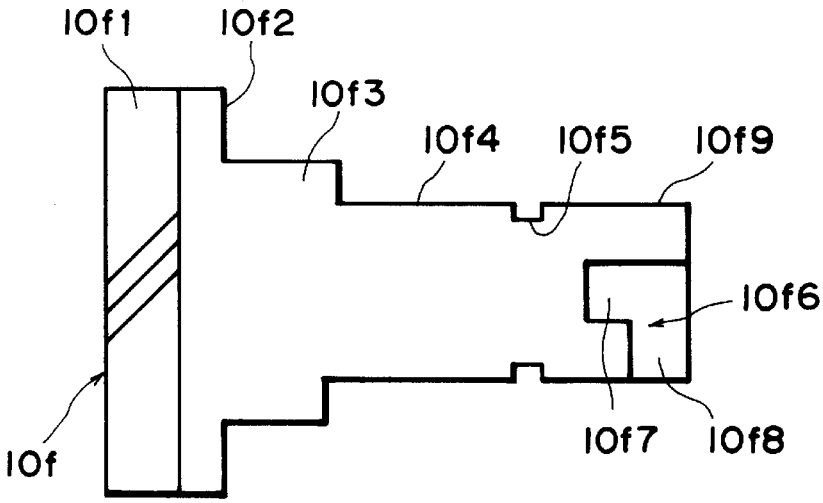
FIG. 2 is a horizontal section of the stirring gear in the first embodiment of the present invention.

FIG. 1 depicts the structure of the toner stirring portion. FIG. 2 is a longitudinal section of the stirring gear. The structure of the toner stirring portion will be described with reference to these two drawings.

Referring to FIG. 1, a stirring rod 10*e* is shaped like a crank shaft, one end of which is fixed to, being thereby supported by, a stirring gear 10*f*, and the other end of which is supported by a development chamber wall 12, so that it is rotated through the toner filled in the toner chamber 10*a* as the stirring gear 10*f* is rotated. The helical tooth portion 1011 of the stirring gear 10*f* is meshed with a helical gear 10*j* which receives a driving force from the drum gear 7*a* solidly fixed to the end of the photosensitive drum 7. It should be noted here that the stirring gear 10*f* with helical teeth is attached to the toner chamber wall 12 in such a manner that it is movable in the thrust direction substantially perpendicular to the rotational direction thereof. This is because production and/or assembly errors involving the helical gear and the like components must be taken into consideration. Further, the stirring gear 10*f* with helical teeth is afforded a play that allows it to move in the thrust direction, with the boss portion 10*f*3 of the stirring gear sliding on the internal surface of a bearing 12*a*1.

Referring to FIG. 2, the stirring gear 10*f* comprises the helical tooth portion 10*f*1, a thrust-bearing portion 10*f*2 which is one of the inward facing surfaces of the stirring gear 10*f*, a cylindrical boss portion 10*f*3 having a smaller diameter than the external diameter of the helical tooth portion 10*f*1, a cylindrical sealing portion 10*f*4 having a smaller diameter than the boss portion 10*f*3, a groove portion 10*f*5 on the inward side of the sealing portion 10*f*4, and an end portion 10*f*9 with a hollow 10*f*6. This hollow 10*f*6 is constituted of a center hole portion 10*f*7 in which the journal portion 10*e*1 of the stirring rod 10*e* is fitted, and a groove portion 10*f*8 which has a perfect width for the arm portion 10*e*2 of the stirring rod 10*e*.

Referring again to FIG. 1, the boss portion 10*f*3 is rotatively supported by the internal surface 12*a*1, a bearing surface, of the cylindrical projection 12*a* of the toner chamber wall 12.

The groove portion 10*f*5 and the end portion 10*f*9 with the hollow 10*f*6 are the portions which project into the toner chamber 10*a* after the stirring gear 10*f* is attached to the toner chamber wall 12. In the hollow 10*f*6, the journal 10*e*1 at one end of the stirring rod 10*e*, and the arm portion 10*e*2 continuous with the journal 10*e*1, are fitted. The groove portion 10*f*5 is situated to afford the stirring gear 10*f* a slight movement in the thrust direction even after the stirring gear 10*f* is attached to the toner chamber wall, and an E-shaped retainer ring 10*g* for regulating the movement of the stirring gear in the axial direction is fitted in the groove portion 10*f*5. More specifically, referring to FIG. 1, the E-shaped retainer ring is such a retainer that prevents the stirring gear 10*f* from moving leftward too far and slipping out of the toner chamber wall 12 after assembly, yet affords the stirring gear slight movement in the thrust direction.

The distance K1 between the thrust-bearing surface 10*f*2, and the left end vertical surface of the groove portion 10*f*5 in which the retainer ring 10*g* is fitted, is greater than the distance K2 between the thrust-bearing surface 10*f*2 and the internal surface 12*b* of the toner chamber wall 12.

In order to prevent the toner T from leaking out of the toner chamber 10*a*, a sealing member 10*h* composed of rubber or the like material is fitted around the cylindrical sealing portion 10*f*4 in such a manner that the lip portion 10*h*1 of the sealing member 10*h* remains in contact with the peripheral surface of the cylindrical sealing portion 10*f*4, and the peripheral surface 10*h*2 of the sealing member 10*h* remains in contact with the internal surface 12*a*1 of the cylindrical projection 12*a*.

The helical tooth portion 10*f*1 and the thrust-bearing portion 10*f*2 are outside the toner chamber 10*a*, and the force which drives the stirring rod 10*e* is transmitted to the helical tooth portion 10*f*1 from the helical gear 10*j* meshed therewith. The teeth of the helical gear 10*j* are angled toward the right, and the rotational direction of the helical gear 10*j* is counterclockwise (direction indicated by an arrow mark A2 in FIG. 1) as seen from outside the toner chamber 10*a*. On the other hand, the helical teeth of the stirring gear 10f are angled to the left, and the rotational direction of the stirring gear 10*f* is opposite to that of the helical gear 10*j*, that is, the clockwise direction (direction indicated by an arrow mark A1 in FIG. 1) as seen from outside the toner chamber 10*a*. Also in FIG. 1, a stopper 10*s* is provided to regulate the leftward movement of the helical gear 10*j*.

With the pertinent components being disposed in the above described positional relation, as the driving force is transmitted from the helical gear 10*j* to the tooth portion 10*f*1 of the stirring gear 10*f* through a gear train, a thrusting force is generated due to the way the teeth are cut on the stirring gear 10*f* and the helical gears 10*f*. As for the direction of the thrusting force, the helical gear 10*j* generates thrusting force in the leftward direction of FIG. 1, and the stirring gear 10*f* generates in the rightward direction, that is, the direction to thrust the stirring gear 10*f* toward the toner chamber 10*a*. If, at this time, the helical gear 10*j* is not in contact with the stopper 10*s*, the helical gear 10*j* moves until it comes in contact with the stopper 10*s*, and remains in contact with it. It should be noted here that the aforementioned positional relations among the pertinent components are such that even in this condition, a space large enough to prevent the sealing member 10*h* from being compressed and bent toward the axis of the stirring gear 10*f* is secured as illustrated in FIG. 1 (L1>L2, wherein L1 is the dimension, in the axial direction of the stirring gear 10*f*, of the space in which the sealing member 10*f*2 is accommodated, and L2 is the dimension of the sealing member 10*h* in the same direction). As long as the thrust-bearing portion 10*f*2 remains in contact with the thrust-bearing portion 12*a*2 of the cylindrical projection 12*a*, the retainer ring 10*g* fitted in the groove portion 10*f*5 cannot come in contact with the internal surface of the toner chamber wall 12, and in this condition, the stirring gear 10*f* is rotated in the direction of an arrow mark A3 in the FIG. 4, and therefore, the stirring rod 10*e* is rotated in the same direction to stir the toner T.

(Effects)

With the above described structure in place, the retainer ring never comes in contact with the toner chamber wall, and therefore, the phenomenon that the toner becomes coarse due to the heat generated by the friction between the retainer ring and the toner chamber wall never occurs. As a result, it is possible to always produce a desirable image.

Embodiment 2

Figure 7:
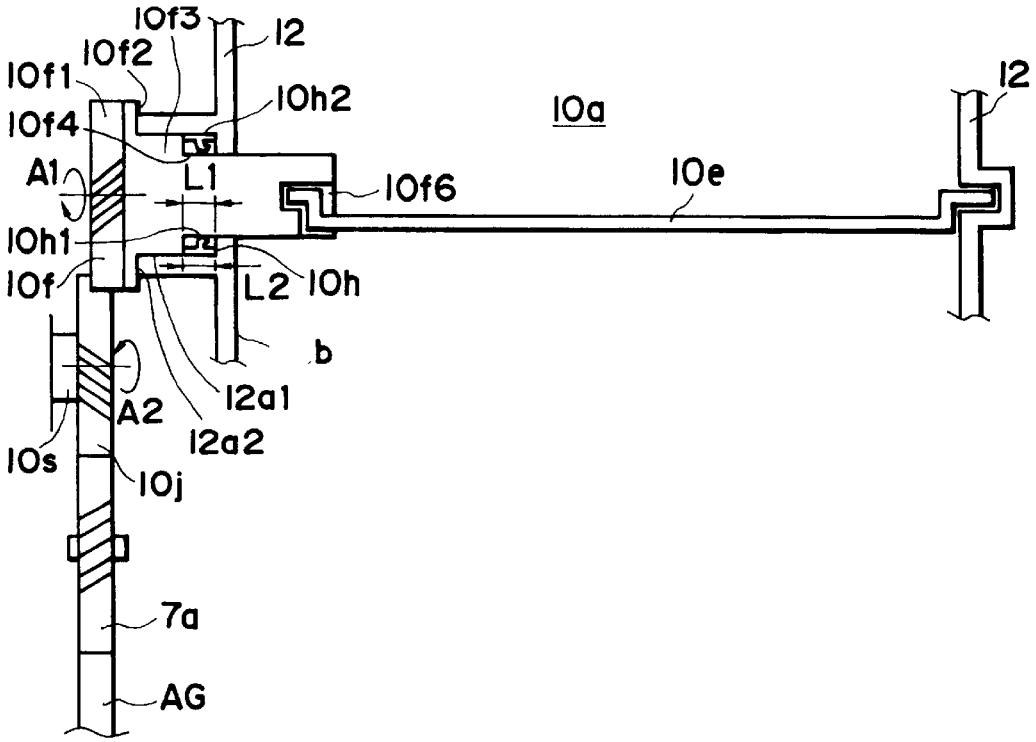
FIG. 7 is a horizontal section of the toner stirring portion in the second embodiment of the present invention, depicting the general structure thereof.

FIG. 7 depicts the structure of the toner stirring portion in the second embodiment in which the groove portion 10*f*5 and the E-shaped retainer ring 10*g* illustrated in FIG. 1 are not present. In other words, in this embodiment, a means, such as a retainer ring, for preventing the stirring gear 10*f* from slipping out of the toner chamber wall 12 is eliminated, and therefore, it never occurs that the internal surface 12*b* of the toner chamber wall 12 makes contact with the means for retaining the stirring gear 10*f*. Even without a dedicated retaining means, the stirring gear 10*f* does not slip out of the toner chamber wall 12, because the meshing between the stirring gear 10*f* the helical gear 10*j*, and the presence of the resistance from the gear train meshed with the helical gear 10*j*, provides the stirring gear 10*f* with a force which works in the direction to retain the stirring gear 10*f*; in other words, the helical gear 10*j* serves as a stopper, the retaining means, for the stirring gear 10*f*.

(Effects)

Without a retainer such as the E-shaped retainer ring in the preceding embodiment, there is no chance that toner is sandwiched between the retainer and the toner chamber wall 12, and rubbed by them. Therefore, the phenomenon that toner becomes coarse is reliably prevented to produce a desirable image, and also, the production cost is reduced.

Embodiment 3

In the preceding two embodiments, the moving member, that is, the stirring rod 10*e*, was disposed within the toner chamber 10*a*. However, the dispersion of the moving member does not need to be in the toner chamber 10*a*; it may be disposed in the development chamber 10*b* or the waste toner collector 11*b*, as a stirring rod 10*i* or as waste toner conveying member 11*c*, which are, respectively, designed to stir the toner, as shown in FIG. 9.

Figure 8:
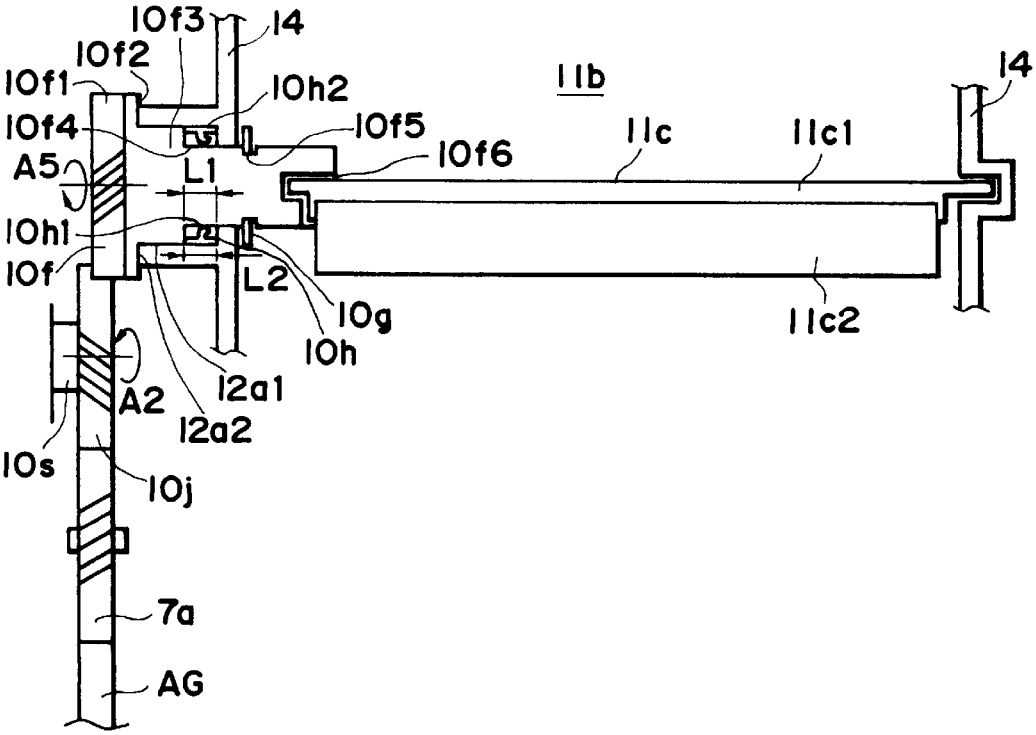
FIG. 8 is a horizontal section of the toner stirring portion of the third embodiment of the present invention, depicting the general structure thereof.
Figure 9:
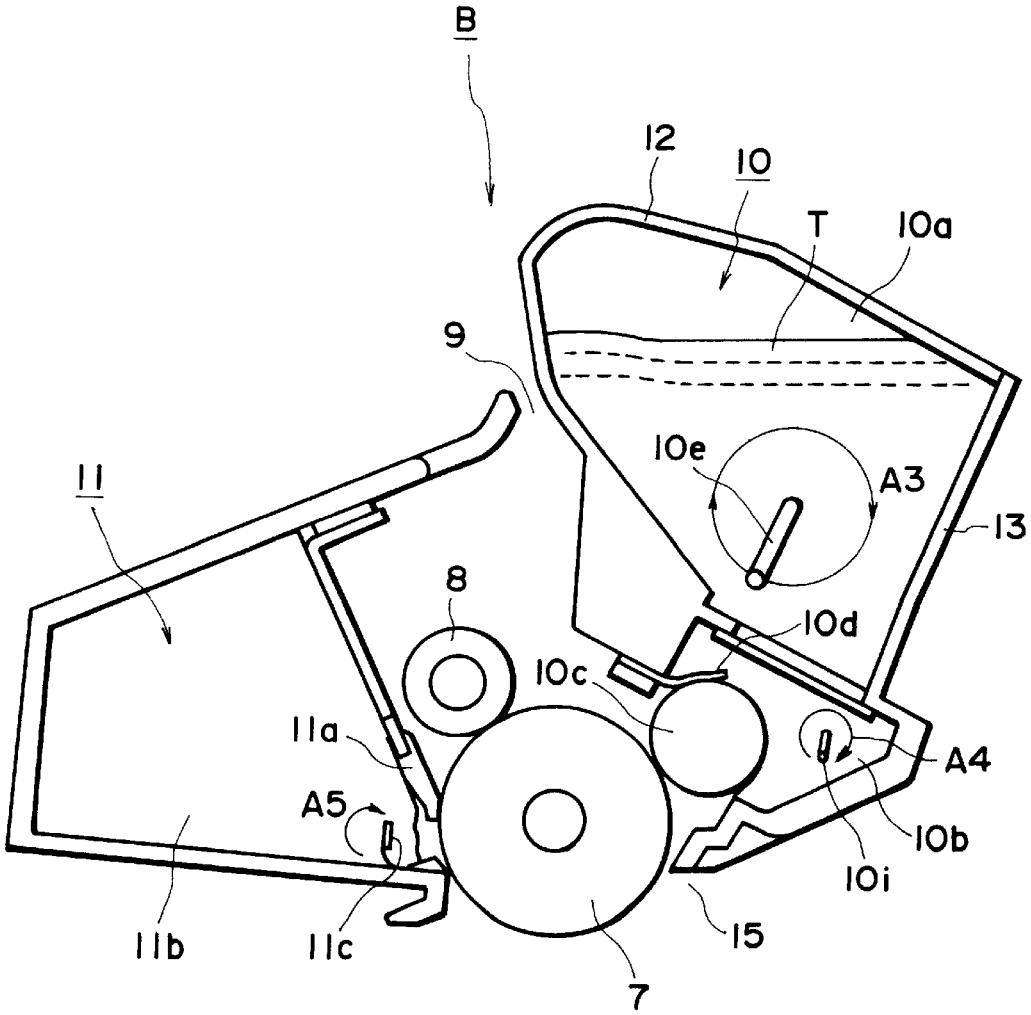
FIG. 9 is a vertical section of the process cartridge in the third embodiment of the present invention, depicting the general structure thereof.

For example, FIGS. 8 and 9 depict an embodiment in which the moving member is the waste toner conveying member 11, and the container in which the moving member is disposed is the waste toner collector 11*b*. In FIG. 9, the stirring rod 10*i* which moves in the development chamber 10*b* is illustrated in addition to the waste toner conveying member 11*c*. The stirring rod 10*i* rotates clockwise (direction indicated by an arrow mark A4) to stir the toner T in the development chamber 10*b*. The waste toner conveying member 11*c* comprises an axis portion 11*c*1, and a conveying portion 11*c*2 radially fixed to the axis portion Ilcl, as shown in FIG. 8. It rotates in the direction indicated by an arrow mark A5 in FIG. 9 to convey the waste toner, which has been scraped off by the cleaning blade 11*a*, deeper into the rear portion of the waste toner collector 11*b*. The structures of the other portions are the same as those described in the first embodiment.

(Effects)

The phenomenon that unwanted lines appear in a finished image, due to failure in cleaning the photosensitive drum 7 caused by the coarse toner particles created in a cleaning means container, can be prevented, and therefore, it is possible to always produce a desirable image.

Embodiment 4

The structure of the toner stirring portion in this fourth embodiment is similar to that in the third embodiment, except for the lack of the retainer ring 10*g*.

Figure 10:
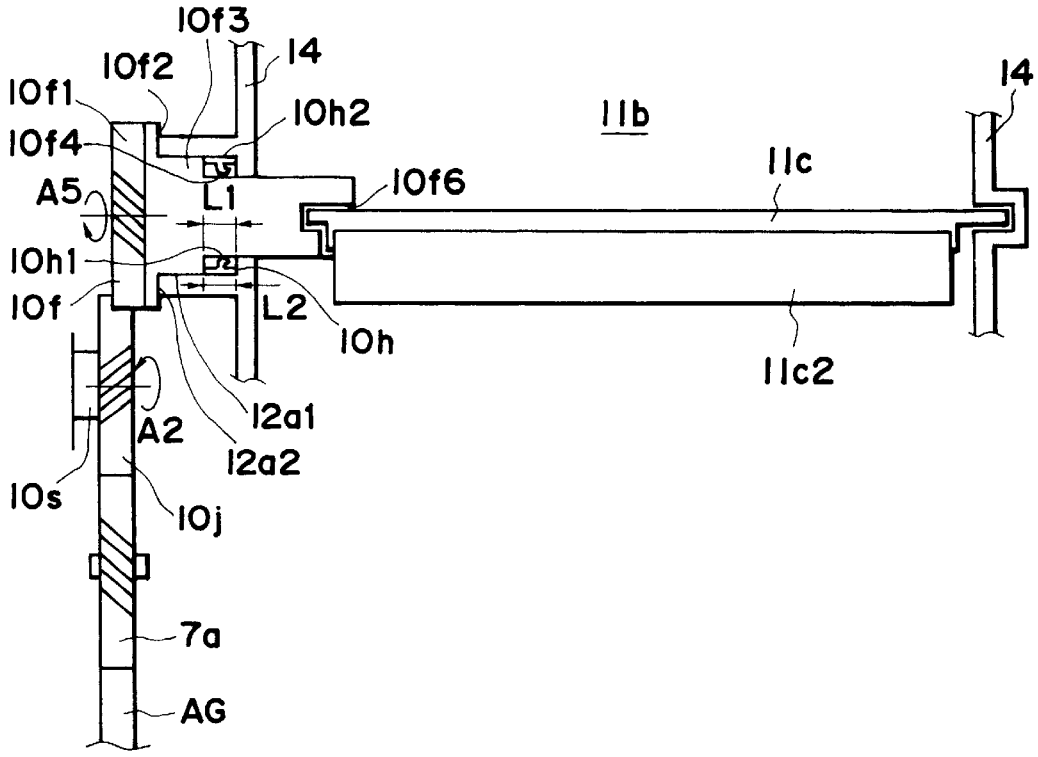
FIG. 10 is a horizontal section of the toner stirring portion in the fourth embodiment of the present invention, depicting the general structure thereof.

Also in this fourth embodiment, the groove portion 10*f*5 and the E-shaped retainer ring 10*g* are unnecessary, as they were in the second embodiment. FIG. 10 depicts the structure of the toner stirring portion in this embodiment. In FIG. 10, the functional portions identical to those illustrated in FIG. 8 will be designated with the same referential symbols in order to omit their description.

(Effects)

Cleaning failure does not occur, and therefore, it is possible to always produce a desirable image, and in addition, to reduce production cost for the apparatus.

The following should be noted here. That is, in this specification of the present invention, "toner container" refers to any of the following: a toner container with a framed structure (toner chamber frame) which stores the toner, that is, developer, without releasing it into a development chamber until process cartridge usage begins; a development chamber frame (development chamber wall) which constitutes a development chamber into which the toner within the toner container is delivered as the process cartridge usage begins; and a cleaning means container in which waste toner is collected.

As described above, according to the present invention, the phenomenon that toner or waste toner in a container becomes coarse due to the heat generated by the friction within the container does not occur, and therefore, a desirable image can be produced.

Further, a stirring gear is properly retained at a predetermined position only by the force generated in the thrust direction by the helical tooth portion thereof, and therefore, not only can the above effects be obtained, but also, the production cost for an image forming apparatus can be reduced.

Further, when the present invention is applied to a cleaning means, cleaning failure can be prevented, and therefore, a desirable image is always produced.

While the invention has been described with reference to the structures disclosed herein, it is not confined to the details set forth and this application is intended to cover such modifications or changes as may come within the purposes of the improvements or the scope of the following claims.

What is claimed is:

1. A toner container mountable to a main assembly of an electrophotographic image forming apparatus, comprising:

a toner containing portion for containing toner;

a rotatable toner stirring member for stirring the toner contained in said toner containing portion;

a helical gear for receiving a driving force for rotating said stirring member, said helical gear being movable in a thrust direction which is substantially crossing with a direction of rotation thereof;

an opposite member opposed to an internal surface of said toner containing portion with a gap therebetween, said opposite member being rotatable together with said helical gear, wherein said opposite member functions as a locking member for preventing the helical gear from disengaging from a toner frame constituting said toner containing portion;

wherein said helical gear produces a thrust force in a direction of maintaining said gap when said helical gear is rotated.

2. A toner container according to claim 1, wherein said locking member is in the form of a collar.

3. A toner container according to claim 1, wherein said toner containing portion is provided with a helical gear portion outside thereof, and an inner side of said helical gear portion supports an end of said toner stirring member, and wherein said helical gear is rotated by the driving force received by said helical gear portion to rotate said toner stirring member.

4. A toner container according to claim 3, further comprising a sealing member, between said helical gear and the toner frame outside said toner frame, for preventing leakage of toner to the outside.

5. A toner container according to claim 1, wherein said helical gear is composed of plastic resin material, and a helical gear portion thereof for receiving the driving force for rotating said toner stirring member and a supporting portion for supporting an end of said toner stirring member are integrally molded, and the helical gear portion is disposed outside said toner containing portion, and wherein the supporting portion is inside said toner containing portion.

6. A toner container according to claim 5, wherein said helical gear portion receives the driving force from a drum helical gear which is engageable with a helical gear of the main assembly, wherein said drum helical gear is provided at one end of an electrophotographic photosensitive drum to transmit the driving force received from the main assembly to the helical gear portion and said drum.

7. A process cartridge according to claim 1, wherein said helical gear is composed of plastic resin material, and a helical gear portion thereof for receiving the driving force for rotating said toner stirring member and a supporting portion for supporting an end of said toner stirring member are integrally molded, and the helical gear portion is disposed outside said toner containing portion, and wherein the supporting portion is inside said toner containing portion.

8. A process cartridge according to claim 7, wherein said helical gear portion receives a driving force from a drum helical gear which is engageable with a helical gear of the main assembly, wherein said drum helical gear is provided at one end of an electrophotographic photosensitive drum as said electrophotographic photosensitive member to transmit the driving force received from the main assembly to the helical gear portion and said drum.

9. A toner container mountable to a main assembly of an electrophotographic image forming apparatus, comprising:

a toner containing portion for containing toner;

a rotatable toner stirring member for stirring the toner contained in said toner containing portion;

a helical gear for receiving a driving force for rotating said stirring member, said helical gear being movable in a thrust direction which is substantially crossing with a direction of rotation thereof;

an opposite member opposed to an internal surface of said toner containing portion with a gap therebetween, said opposite member being rotatable together with said helical gear, wherein said opposite member functions as a locking member for preventing the helical gear from disengaging from a toner frame constituting said toner containing portion;

wherein said helical gear produces a thrust force in a direction of maintaining said gap when said helical gear is rotated, wherein said helical gear includes a helical gear portion for receiving the driving force for rotating said toner stirring member, and an abutment for permitting said toner frame to receive a thrust force produced when said helical gear is rotated, wherein a distance K1 between said abutment and said opposite member is larger than a distance K2 between said abutment and the inside surface of said toner containing portion.

10. A process cartridge detachably mountable to a main assembly of an electrophotographic image forming apparatus, comprising:

an electrophotographic photosensitive member;

developing means for developing a latent image formed on said electrophotographic photosensitive member;

a toner containing portion for containing toner to be used by said developing means;

a rotatable toner stirring member for stirring the toner contained in said toner containing portion;

a helical gear for receiving a driving force for rotating said stirring member, said helical gear being movable in a thrust direction which is substantially crossing with a direction of rotation thereof;

an opposite member opposed to an internal surface of said toner containing portion with a gap therebetween, said opposite member being rotatable together with said helical gear, wherein said opposite member functions as a locking member for preventing the helical gear from disengaging from a toner frame constituting said toner containing portion;

wherein said helical gear produces thrust force in a direction of maintaining said gap when said helical gear is rotated.

11. A process cartridge according to claim 10, wherein said locking member is in the form of a collar.

12. A process cartridge according to claim 9, wherein said toner containing portion is provided with a helical gear portion outside thereof and an inner side of said helical gear portion support an end of said toner stirring member, and wherein said helical gear is rotated by the driving force received by said helical gear portion to rotate said toner stirring member.

13. A process cartridge according to claim 12, further comprising a sealing member, between said helical gear and the toner frame outside said toner frame, for preventing leakage of toner to the outside.

14. A process cartridge detachably mountable to a main assembly of an electrophotographic image forming apparatus, comprising:

an electrophotographic photosensitive member;

developing means for developing a latent image formed on said electrophotographic photosensitive member;

a toner containing portion for containing toner to be used by said developing means;

a rotatable toner stirring member for stirring the toner contained in said toner containing portion;

a helical gear for receiving a driving force for rotating said stirring member, said helical gear being movable in a thrust direction which is substantially crossing with a direction of rotation thereof;

an opposite member opposed to an internal surface of said toner containing portion with a gap therebetween said opposite member being rotatable together with said helical gear, wherein said opposite member functions as a locking member for preventing the helical gear from disengaging from a toner frame constituting said toner containing portion;

wherein said helical gear produces thrust force in a direction of maintaining said gap when said helical gear is rotated, wherein said helical gear includes a helical gear portion for receiving the driving force for rotating said toner stirring member, and an abutment for permitting said toner frame to receive a thrust force produced when said helical gear is rotated, wherein a distance K1 between said abutment and said opposite member is larger than a distance K2 between said abutment and the inside surface of said toner containing portion.

15. An electrophotographic image forming apparatus for forming an image on a recording material, to which a process cartridge is detachably mountable, comprising:

a process cartridge detachably mountable to a main assembly of an electrophotographic image forming apparatus, wherein said process cartridge includes:

an electrophotographic photosensitive member;

developing means for developing a latent image formed on said electrophotographic photosensitive member;

a toner containing portion for containing toner to be used by said developing means;

a rotatable toner stirring member for stirring the toner contained in said toner containing portion;

a helical gear for receiving a driving force for rotating said stirring member, said helical gear being movable in a thrust direction which is substantially crossing with a direction of rotation thereof;

an opposite member opposed to an internal surface of said toner containing portion with a gap therebetween, said opposite member being rotatable together with said helical gear, wherein said opposite member functions as a locking member for preventing the helical gear from disengaging from a toner frame constituting said toner containing portion;

wherein said helical gear produces thrust force in a direction of maintaining said gap when said helical gear is rotated with said opposite member being spaced from the internal surface of toner containing portion, is oriented in a direction from outside to inside of said toner containing portion;

mounting means for mounting said process cartridge to the main assembly; and means for feeding the recording material.

16. A process cartridge detachably mountable to a main assembly of an electrophotographic image forming apparatus, wherein said process cartridge includes:

an electrophotographic photosensitive member;

a developing roller for developing a latent image formed on said electrophotographic photosensitive member;

a toner container for containing toner to be used by said developing roller;

a movable opposite member opposed to an internal surface of said toner container with a gap therebetween, said opposite member being rotatable together with a helical gear, wherein said opposite member functions as a locking member for preventing the helical gear from disengaging from a toner frame constituting said toner containing portion;

a drive transmission member for transmitting the driving force to said opposite member from outside; and a toner sealing member between said container and said drive transmission member;

wherein said drive transmission member comprises the helical gear for the drive transmission, and the helical gear is twisted such that thrust force produced when said helical gear is rotated is oriented;

in a direction of maintaining said gap.

17. A process cartridge according to claim 16, further comprising a member mounted to said toner container so as to be slidable relative to an outer circumferential periphery of said drive transmission member between said helical gear and said opposite member.

18. A process cartridge according to claim 16, further comprising a thrust receiving portion outside said container, said thrust receiving portion receiving the thrust force produced by said helical gear.

19. A process cartridge according to claim 16, further comprising charging means and cleaning means.

20. A process cartridge according to claim 16, wherein said container hermetically contains the toner therein before use thereof, said container further comprising a stirring member for stirring the toner when said container is unsealed upon use thereof.

21. A process cartridge detachably mountable to a main assembly of an electrophotographic image forming apparatus, wherein said process cartridge includes:

an electrophotographic photosensitive member;

a developing roller for developing a latent image formed on said electrophotographic photosensitive member;

a toner container for containing toner to be used by said developing roller;

a movable opposite member opposed to an internal surface of said toner container with a gap therebetween, said opposite member being rotatable together with a helical gear, wherein said opposite member functions as a locking member for preventing the helical gear from disengaging from a toner frame constituting said toner containing portion;

a drive transmission member for transmitting the driving force to said opposite member from outside; and a toner sealing member between said container and said drive transmission member;

wherein said drive transmission member comprises the helical gear for the drive transmission, and the helical gear is twisted such that the thrust force produced when said helical gear is rotated is oriented in a direction of maintaining said gap, wherein said drive transmission member includes a helical gear portion, and abutment, at an axial end, for transmitting the thrust force, and a locking portion for preventing outward axial movement, and said container has a thrust receiving portion for being abutted by at least an abutment portion of said drive transmission member, wherein a distance K1 between said abutment portion and said locking portion is larger than a distance K2 between said thrust receiving portion and the inner surface of said container.

22. A helical stirring gear and a retainer for retaining said helical gear in a toner chamber wall having an internal surface, said helical gear receiving a driving force for rotating a stirring member stirring toner contained in a toner containing portion of a toner container having the toner chamber wall and being mountable to a main assembly of an electrophotographic image forming apparatus, said helical gear being movable in a thrust direction which is substantially crossing with a direction of rotation thereof, said helical stirring gear comprising:

a helical tooth portion at one end thereof for receiving the driving force;

a thrust-bearing portion comprising an inward-facing, thrust-bearing surface and abutting said helical tooth portion;

a cylindrical boss portion abutting said thrust-bearing portion and having a smaller diameter than the external diameter of said helical tooth portion;

a cylindrical sealing portion abutting said cylindrical boss portion and having a smaller diameter than said cylindrical boss portion;

a groove portion abutting said cylindrical sealing portion, said groove portion having a left-end vertical surface; and an end portion abutting said groove portion and positioned at the other end of said helical gear from said helical tooth portion, said end portion including a hollow portion for receiving the stirring member, the hollow having a center hole and a groove; and said retainer comprising:

a substantially E-shaped retainer ring for regulating movement of said helical stirring gear in the axial direction, wherein said retainer ring is fitted into said groove portion of said helical stirring gear, wherein said retainer ring prevents said helical stirring gear from slipping out of the toner chamber wall while affording said helical stirring gear movement in the thrust direction, wherein the distance between said inward-facing, thrust-bearing surface and the left-end vertical surface of said groove portion is greater than the distance between said inward-facing, thrust-bearing surface and the internal surface of the toner chamber wall, whereby said retainer ring is spaced from the internal surface of the toner chamber wall with a gap therebetween, and wherein said helical stirring gear produces a thrust force in a direction of maintaining said gap when said helical stirring gear is rotated.

23. A retainer for retaining a helical stirring gear in a toner chamber wall having an internal surface, said helical gear receiving a driving force for rotating a stirring member stirring toner contained in a toner containing portion of a toner container having the toner chamber wall and being mountable to a main assembly of an electrophotographic image forming apparatus, said helical gear being movable in a thrust direction which is substantially crossing with a direction of rotation thereof, said helical stirring gear comprising: a helical tooth portion at one end thereof for receiving the driving force; a thrust-bearing portion comprising an inward-facing, thrust-bearing surface and abutting said helical tooth portion; a cylindrical boss portion abutting said thrust-bearing portion and having a smaller diameter than the external diameter of said helical tooth portion; a cylindrical sealing portion abutting said cylindrical boss portion and having a smaller diameter than said cylindrical boss portion; a groove portion abutting said cylindrical sealing portion, said groove portion having a left-end vertical surface; and an end portion abutting said groove portion and positioned at the other end of said helical gear from said helical tooth portion, said end portion including a hollow portion for receiving the stirring member, the hollow having a center hole and a groove, said retainer comprising:

a substantially E-shaped retainer ring for regulating movement of said helical stirring gear in the axial direction, wherein said retainer ring is fitted into said groove portion of said helical stirring gear, wherein said retainer ring prevents said helical stirring gear from slipping out of the toner chamber wall while affording said helical stirring gear movement in the thrust direction, wherein the distance between said inward-facing, thrust-bearing surface and the left-end vertical surface of said groove portion is greater than the distance between said inward-facing, thrust-bearing surface and the internal surface of the toner chamber wall, whereby said retainer ring is spaced from the internal surface of the toner chamber wall with a gap therebetween, and wherein said helical stirring gear produces a thrust force in a direction of maintaining said gap when said helical stirring gear is rotated.

* * * * *

UNITED STATES PATENT AND TRADEMARK OFFICE

CERTIFICATE OF CORRECTION

PATENT NO. : 6,047,153
DATED : April 4, 2000
INVENTOR(S) : Hideshi Kawaguchi

It is certified that error appears in the above-identified patent and that said Letters Patent is hereby corrected as shown below:

Column 1:
Line 38, "a like by the" should read --the like by a--.

Column 2:
Line 1, "regainer" should read --retainer--.

Column 4:
Line 61, "transmittion" should read --transmission--.

Column 7:
Line 29, "I1c1," should read --11c1,--.

Column 9:
Line 5, "claim 1," should read --claim 10,--.

Column 11:
Line 10, after "thrust force" insert --,--.
Line 14, delete "is".

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*